US006554641B1

(12) United States Patent
Wu

(10) Patent No.: US 6,554,641 B1
(45) Date of Patent: Apr. 29, 2003

(54) STACKED CONNECTOR ASSEMBLY

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,263

(22) Filed: Dec. 26, 2001

(51) Int. Cl.[7] ..... H01R 13/60
(52) U.S. Cl. ..... 439/541.5
(58) Field of Search ..... 439/541.5, 594, 439/701, 717, 79, 80–82, 101, 108

(56) References Cited

U.S. PATENT DOCUMENTS 5,030,115 A * 7/1991 Regnier et al. ..... 439/541.5
5,336,109 A * 8/1994 Hillbish et al. ..... 439/541.5
5,466,171 A * 11/1995 Bixler et al. ..... 439/378
5,800,207 A * 9/1998 Hsu et al. ..... 439/541.5
5,823,822 A * 10/1998 Tan et al. ..... 439/541.5
5,839,922 A * 11/1998 Orlando et al. ..... 439/717
5,851,125 A * 12/1998 Hsu et al. ..... 439/541.5
5,888,103 A * 3/1999 Norizuki et al. ..... 439/701
5,934,944 A * 8/1999 Aoyama et al. ..... 439/701
6,146,194 A * 11/2000 Lok ..... 439/541.5
6,296,530 B1 * 10/2001 Yoneda et al. ..... 439/701
6,354,875 B1 * 3/2002 Wu ..... 439/108

* cited by examiner

*Primary Examiner*—Renee Luebke
*Assistant Examiner*—Felix O. Figueroa
(74) *Attorney, Agent, or Firm*—Wei Te Chung

(57) ABSTRACT

A stacked connector assembly includes a first connector and a second connector vertically stacked on the first connector. The first connector includes a first housing having a top face on which pairs of sockets are formed. The second connector includes a second housing having a bottom face on which spindles are formed. The second housing is positioned on the first housing with opposite ends of each spindle rotatable received in and supported by a corresponding pair of sockets to hingedly connect the second connector to the first connector. A board lock comprises a base section and two beams respectively received in the first and second housings to secure the first and second connectors together. Resilient and barbed legs depend from the base section to be interferentially fit in a corresponding hole defined in a circuit board for retaining the stacked connector assembly on the circuit board.

18 Claims, 6 Drawing Sheets

STACKED CONNECTOR ASSEMBLY

BACKGROUND OF THE INVENTION

1. Field of the Invention

The present invention generally relates to a stacked connector assembly, and more particular to connectors hinged together to form a stacked connector assembly.

2. The Related Arts

An electrical connector pair of mating each other to connect a first print circuit board, such as a circuit board of a computer disk drive, to a second circuit board, such as a main circuit board of a docking station, are known in the field of connectors, such as SCA-2 based connectors. Such electrical connectors are thus often referred to as "board-to-board" connector. Connectors of similar function for connecting two circuit boards are also available in the market, such as EBBI (Enhanced Board to Board Interface) connector marketed by Molex, Inc. Each pair of the board-to-board connectors comprises a plug (or male) connector and a socket (or female) connector releasably mating each other. An example is disclosed in U.S. Pat. No. 5,466,171.

Connectors stacked together to form a stacked connector assembly are also known in the field of connectors. Examples are shown in for example U.S. Pat. Nos. 5,800,207 and 5,851,125. These stacked connector assemblies require a bracket to secure connectors together. Stacked connector assemblies that include connectors secured together by means of mortise-tenon and/or snap fitting structures are also known. However, a connector stack comprising connectors that are hinged to each other is not known heretofore.

SUMMARY OF THE INVENTION

Accordingly, an object of the present invention is to provide a stacked assembly of connectors hinged together.

Another object of the present invention is to provide a stacked assembly of board-to-board connectors.

To achieve the above objects, in accordance with the present invention, a stacked connector assembly comprises a first connector, such as an SCA-2 based receptacle connector, and a second connector, such as an EBBI based plug connector, vertically stacked on the first connector. The first connector comprises a first housing having a top face on which axially aligned pairs of opposing sockets are formed. The second connector comprises a second housing having a bottom face on which axially aligned spindles are formed. The second housing is positioned on the first housing with opposite ends of each spindle rotatably received in and supported by a corresponding pair of sockets to hingedly connect the second connector to the first connector. Each housing comprises two arms extending rearward from opposite ends thereof. Each arm of the second housing is stacked on the corresponding arm of the first housing. A channel is defined in and extending along each arm. A board lock comprises a vertically extending base section and two transversely extending beams respectively received and interferentially engaging the channels of the arms of the first and second housings to secure the first and second connectors together. Resilient and barbed legs depend from the base section to be interferentially fit in a corresponding hole defined in a circuit board for retaining the stacked connector assembly on the circuit board. A latch depends from each arm of the second housing and engages a notch defined in the arm of the first housing for fixing the second housing to the first housing.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
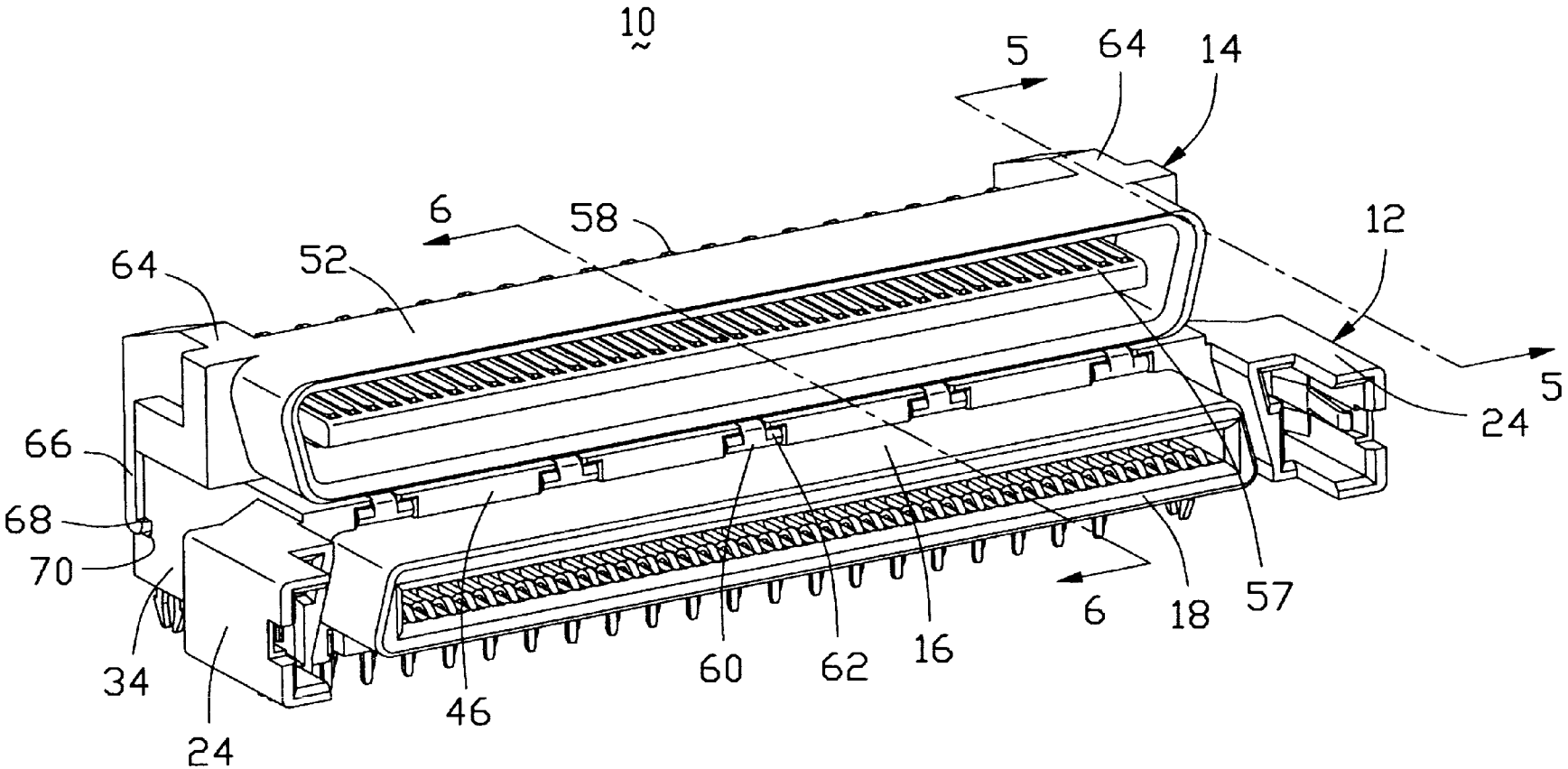
FIG. 1 is a perspective view of a stacked connector assembly in accordance with the present invention observed from front side thereof.
Figure 2:
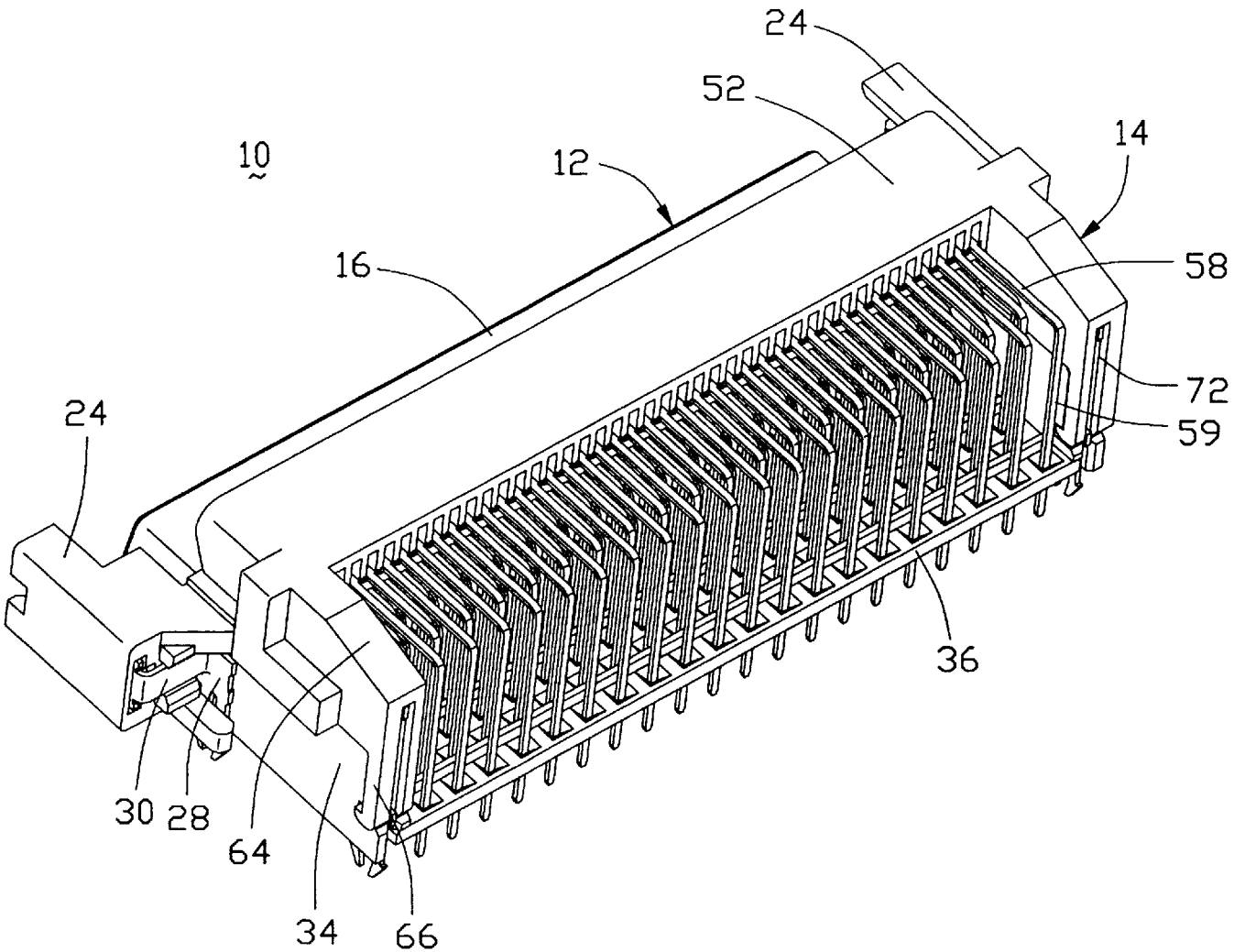
FIG. 2 is another perspective view of the stacked connector assembly observed from rear side thereof.
Figure 3:
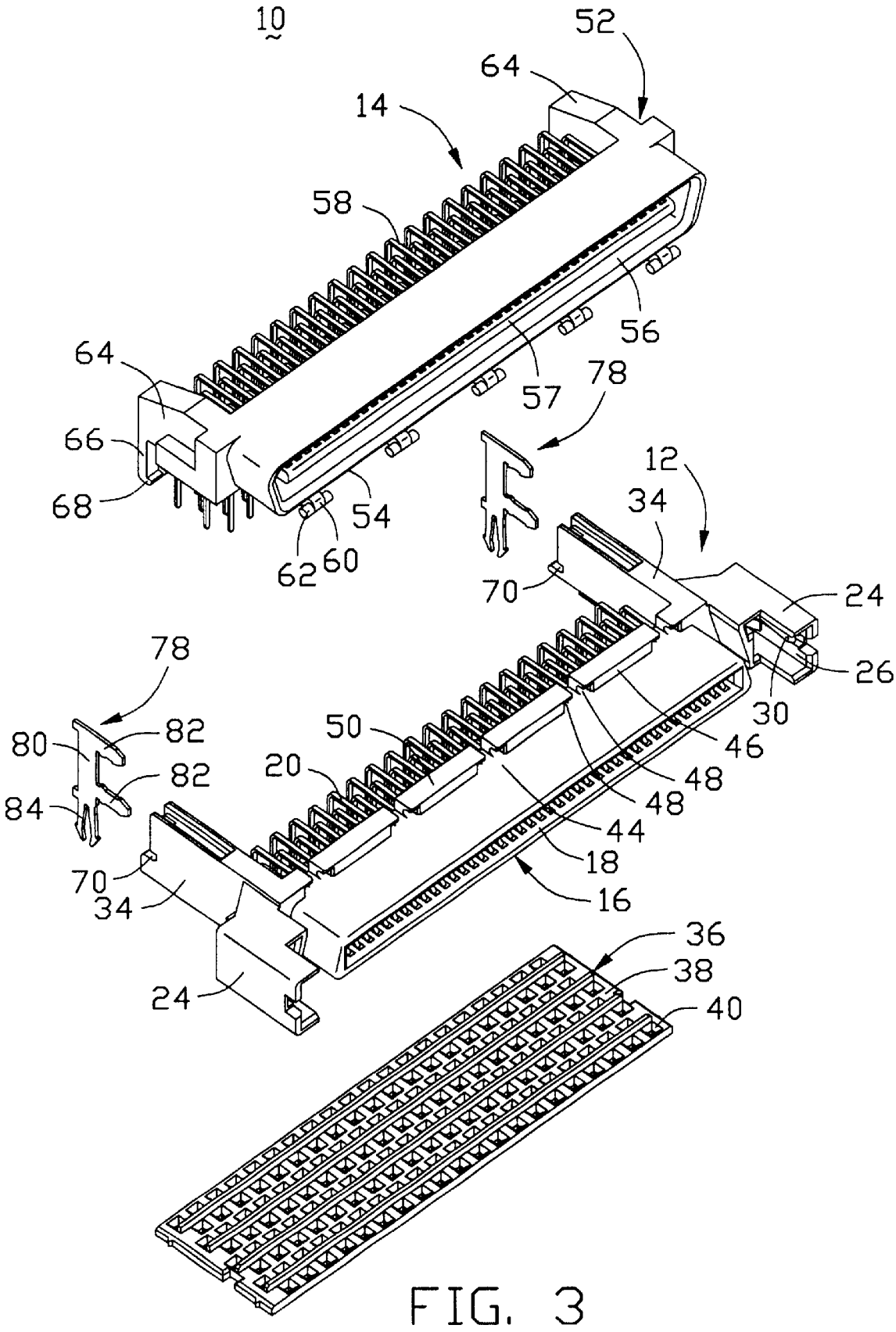
FIG. 3 is an exploded view of FIG. 1.
Figure 4:
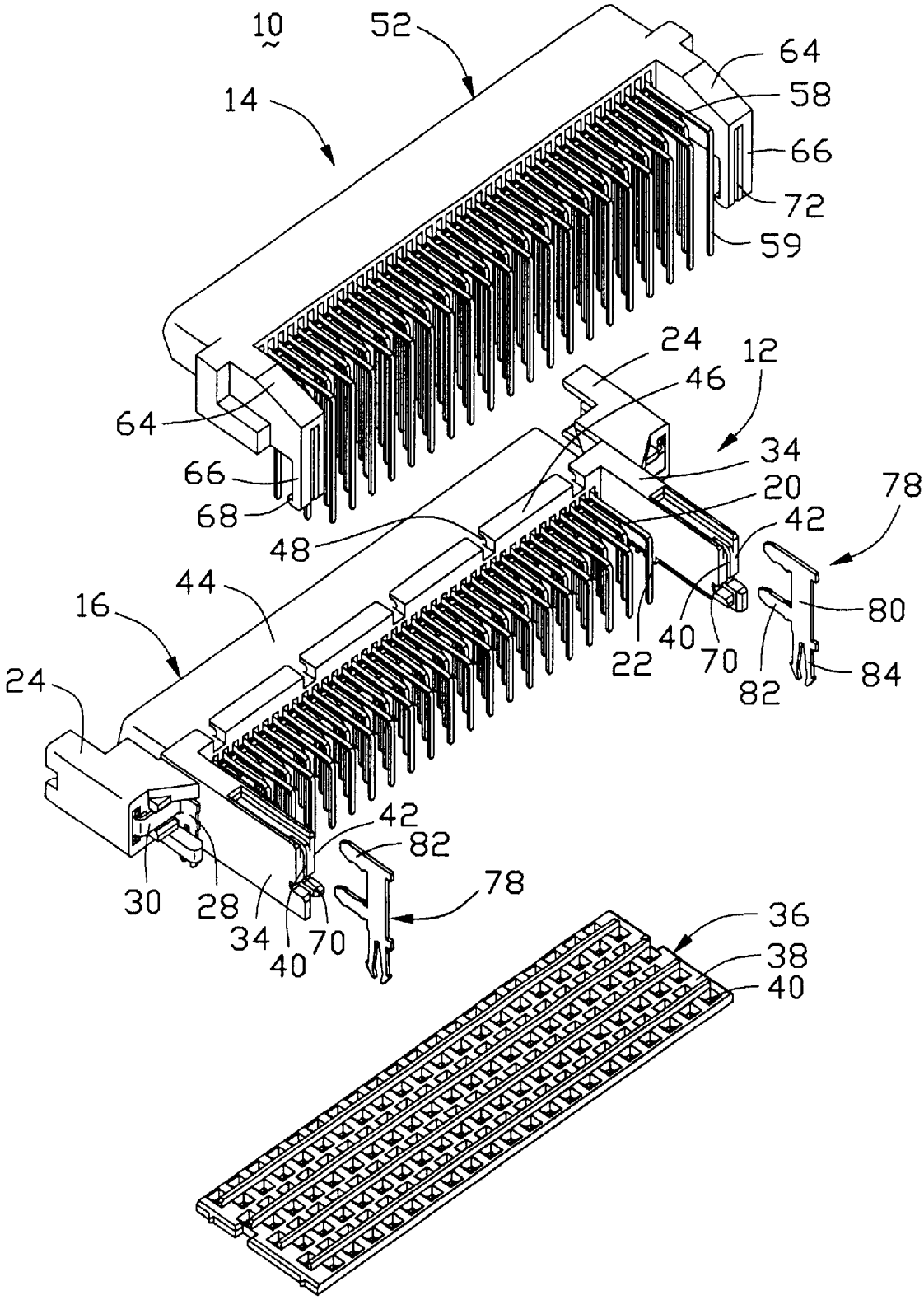
FIG. 4 is an exploded view of FIG. 2.

With reference to the drawings and particularly to FIGS. 1–4, a stacked connector assembly constructed in accordance with the present invention, generally designated with reference numeral 10, comprises a first or lower connector 12, such as an SCA-2 based receptacle connector, and a second or upper connector 14, such as an EBBI based plug connector, vertically stacked on the first connector 12.

Figure 6:
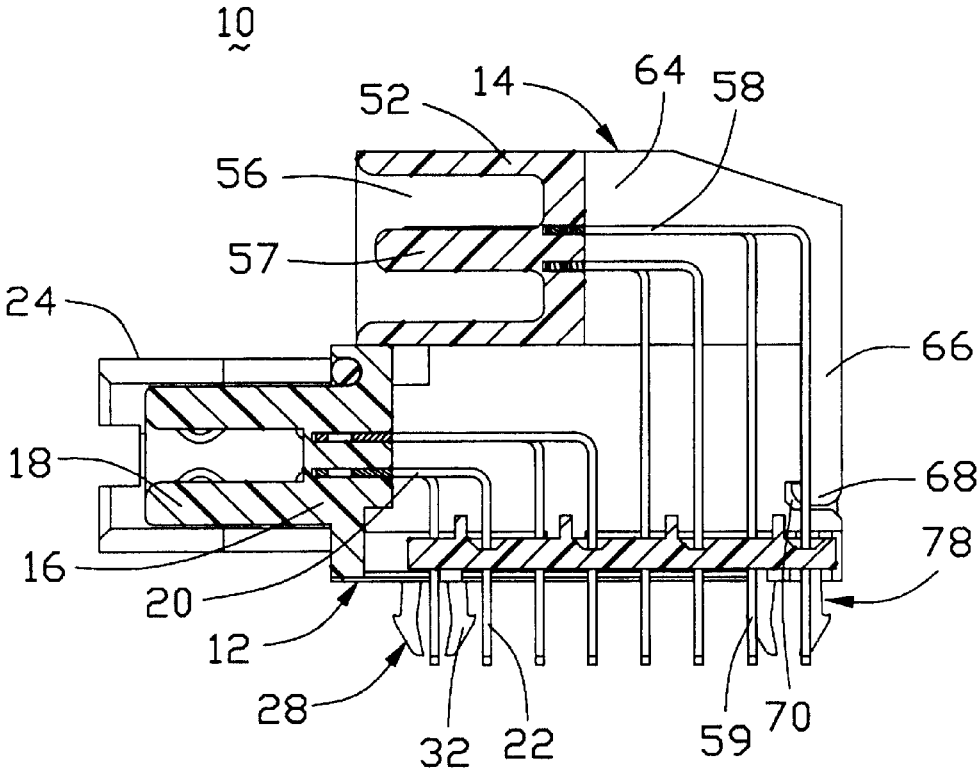
FIG. 6 is a cross-sectional view taken along line 6—6 of FIG. 1.

Also referring to FIG. 6, the first connector 12 comprises a first elongate housing 16 having a front mating face (not labeled) for matingly engaging a first mating connector that is mounted to a circuit board (both not shown). A surrounding wall 18 having opposite portions (not labeled) is formed on and extends from the front mating face of the first housing 16. First conductive terminals 20 are retained in the first housing and arranged along inner surfaces of the opposite portions of the surrounding wall 18 for electrically engaging with the first mating connector. Each first terminal 20 has a tail 22 extending beyond a bottom surface (not labeled) of the first housing 16 for engaging a circuit board (not shown) so as to connect the circuit boards to each other.

The first housing 16 has two forward-extending arms 24 extending from opposite ends thereof in a forward direction. The surrounding wall 18 is located between the forward-extending arms 24. Each forward-extending arm 24 forms a guide channel 26 for guidingly receiving a complementary guide post of the first mating connector. A first board lock 28, made of conductive materials, is attached to each end of the first housing 16 and has an extension 30 extending into the guide channel 26 for electrically engaging a corresponding grounding member of the first mating connector to ground the first mating connector. The first board lock 28 has two spaced, resilient, barbed legs 32 for being interferentially fit into a corresponding hole defined in the circuit board to retain the stacked connector assembly 10 on the circuit board.

The first housing 16 also has two rearward-extending arms 34 extending from the ends thereof. A space (not labeled) is defined between the rearward-extending arms 34 for accommodating the tails 22 of the first terminals 20. In the embodiment illustrated, a spacer 36 in the form of a flat plate 36 having a plurality of openings 38 is retained between the rearward-extending arms 34 of the first housing 16 with the tails 22 of the first housing 20 extending through the corresponding openings 38. The tails 22 are thus prevented from contacting each other and short-circuiting is avoided.

Each rearward-extending arm 34 defines a first, vertically-extending slit 40 in a remote end face 42 thereof. This will be further discussed.

The first housing 16 has a top face 44 on which a lengthwise-extending rib comprising a number of spaced but axially-aligned segments 46 is formed. Each segment 46 has opposite ends each forming a socket 48. Each socket 48 of each segment 46 opposes a corresponding socket 48 of an adjacent segment 46, forming a pair of opposing sockets. The rib segments 46 has a flat top surface 50.

The second connector 14 comprises an elongate second housing 52 positionable above the first housing 16 of the first connector 12. The second housing 52 has a length substantially corresponding to that of the first housing 16 of the first connector 12 and a bottom face 54 resting on the flat top surface 50 of the rib segments 46 of the first housing 16. The second housing 52 also has a front mating face in which a cavity 56 is defined for receivingly and engagingly mating a second mating connector (not shown). A tongue plate 57 is arranged in the cavity 56 and retains second terminals 58 made of conductive materials for electrically engaging the second mating connector. Each second terminal 58 has a tail 59 extending through the corresponding openings 40 of the spacer 38 and beyond the bottom surface of the first housing 16 for being soldered to the circuit board. The spacer 38 prevents the tails 59, as well as tails 22 of the first terminals 20, from contacting each other.

Figure 5:
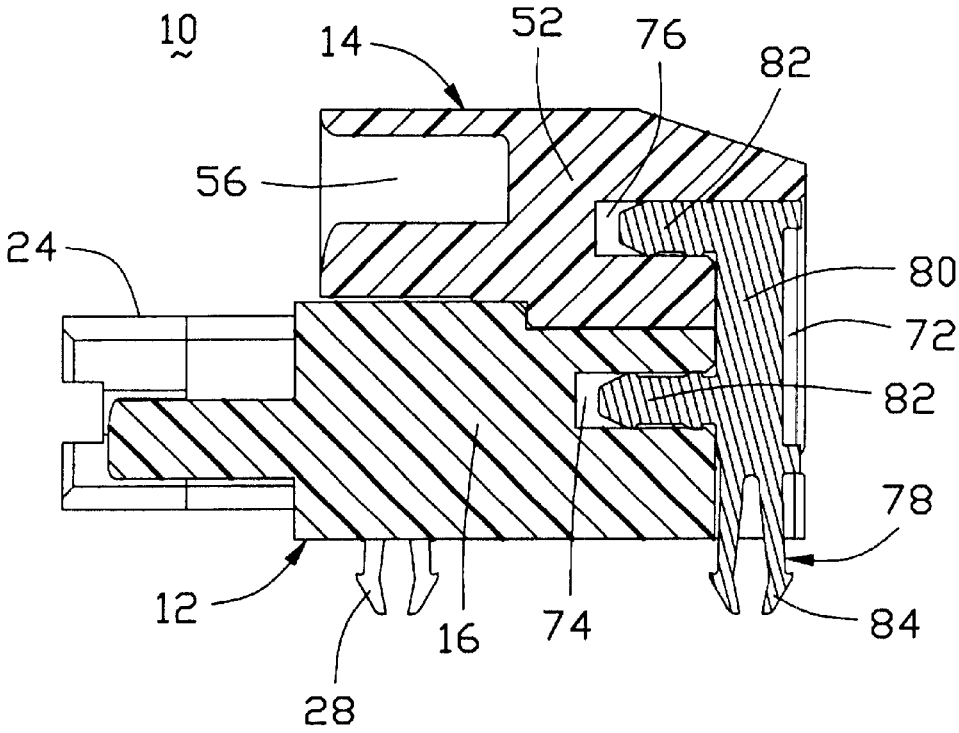
FIG. 5 is a cross-sectional view taken along line 5—5 of FIG. 1.
Figure 7:
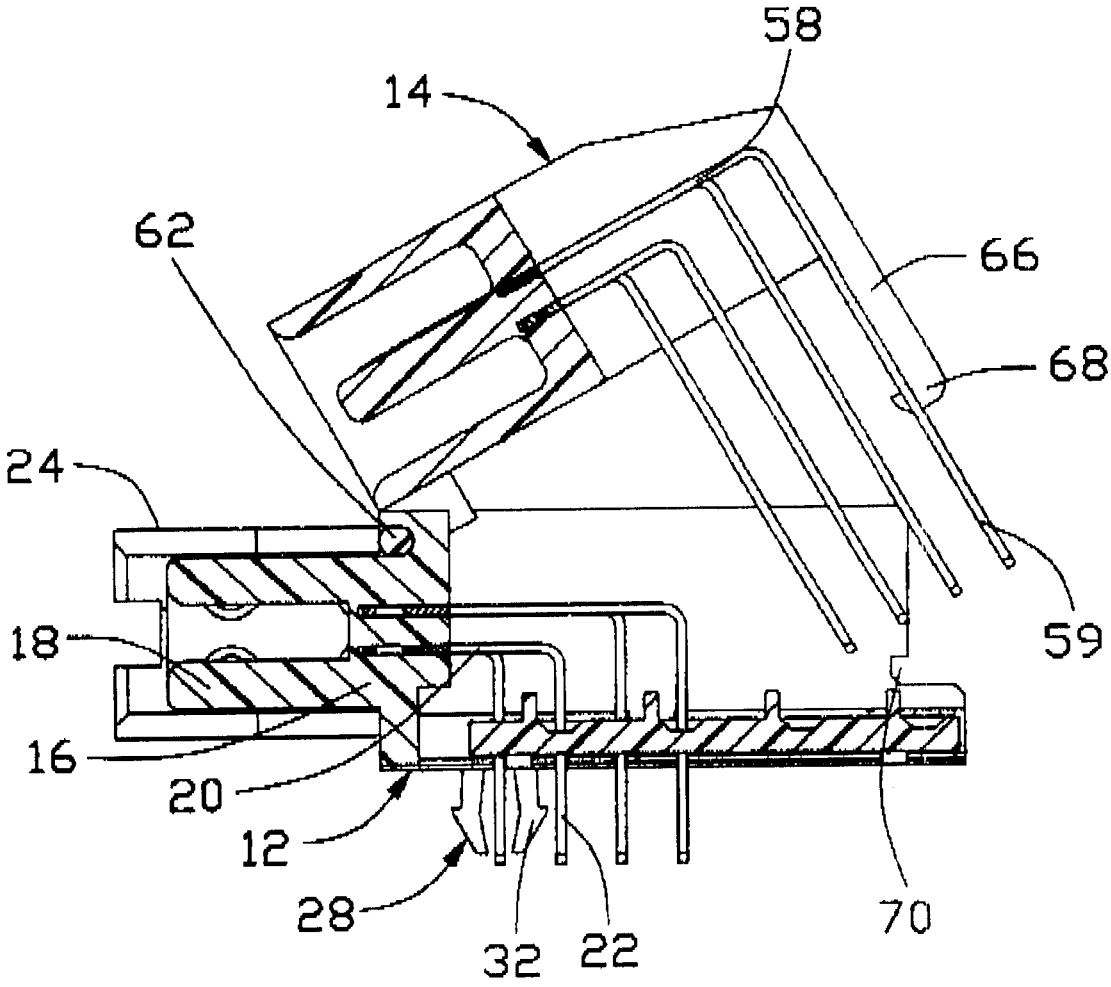
FIG. 7 is a cross-sectional view of FIG. 6, before a second housing of the stacked connector assembly being rotatably coupled to a first housing of the stacked connector assembly.

Also referring to FIGS. 5–7, The second housing 52 forms a number of projections 60 on the bottom face 54 thereof. Each projection 60 is received in the space (not labeled) between adjacent rib segments 46. Each projection 60 retains a pivot pin 62 which has opposite ends extending beyond opposite sides of the projection 60. The ends of the pivot pin 62 are rotatably received in and supported by the pair of sockets 48 associated with the space thereby rotatably mounting the second connector 14 to the first connector 12. The rotatable connection allows relative movement of the second housing 52 with respect to the first housing 16 whereby the second housing 52 is positioned on the flat top surface 50 of the rib of the first housing 16.

The second housing 52 has rearward-extending arms 64 extending from opposite ends thereof in a rearward direction and corresponding in position to and resting on the rearward-extending arms 34 of the first housing 16. A latch 66 depends from each rearward-extending arm 64 and forms a catch 68 received in and engaging with a notch 70 defined in the remote end face 42 of the corresponding rearward-extending arm 34 of the first housing 16 thereby securing the first and second connectors 12, 14 together. A slit 72 in registration with the vertically-extending slit 40 of the rearward-extending arm 34 of the first housing 16 is defined through each latch 66.

Also referring to FIG. 5, each rear-extending arm 34 of the first housing 16 defines a first channel 74 in communication with the vertically-extending slit 40 and extending in a forward direction along the arm 34. Each rear-extending arm 64 of the second housing 52 defines a second channel 76 in communication with the slit 72. A second board lock 78 comprises a vertically-extending base section 80 received in the slit 72 of each latch 66 of the second housing 52 and partially fit into the vertically-extending slit 40 of the first housing 16. The second board lock 78 comprises two barbed beams 82 extending transversely from the base section 80 and interferentially fit into the first and second channels 74, 76 of the rearward-extending arms 34, 64 of the first and second housing 16, 52 to securely fix the second connector 14 to the first connector 12.

The second board lock 78 has two spaced, resilient, barbed legs 84 depending from the base section 80 for interferentially engaging with a hole defined in the circuit board to retain the stacked connector assembly 10 on the circuit board.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A stacked connector assembly comprising:

a first connector comprising a first housing retaining first terminals for electrically engaging a first mating connector, the first housing having a top face on which a first portion of hinge means is formed; and a second connector comprising a second housing retaining second terminals for electrically engaging a second mating connector, the second housing having a bottom face on which a second portion of the hinge means is formed;

wherein the second housing is stacked on the first housing with the bottom face of the second connector positioned on the top face of the first connector, the second portion of the hinge means being rotatably coupled to the first portion of the hinge means to hingedly connect the second connector to the first connector;

wherein the first housing has opposite ends from which two first arms respectively extend in a rearward direction, each first arm having a remote end face defining a notch and wherein the second housing has opposite ends from which two second arms respectively extend in a rearward direction, a latch depending from each second arm and forming a catch engaging the notch to securely fix the second housing to the first housing.

2. The stacked connector assembly as claimed in claim 1, wherein the first portion of the hinge means comprises a pair of sockets and wherein the second portion of the hinge means comprises a pivot pin having opposite ends rotatably received in the sockets.

3. The stacked connector assembly as claimed in claim 2, wherein the first portion of the hinge means comprises a plurality of axially aligned rib segments formed on the top face of the first housing, a space being defined between opposing ends of adjacent segments and each of the opposing ends of the rib segments forming the socket, and wherein the second portion of the hinge means comprises a projection extending from the bottom face of the second housing and received in each space between the rib segments of the first housing, the pivot pin being retained by each projection and having opposite end rotatably received in the sockets formed in the opposing ends of the rib segments.

4. The stacked connector assembly as claimed in claim 1, wherein the first housing has a bottom surface adapted to be positioned on a circuit board, the first and second terminals comprising tails extending beyond the bottom surface of the first housing for being connected to the circuit board, and wherein the stacked connector assembly further comprises a spacer defining openings respectively receiving the tails of the terminals.

5. The stacked connector assembly as claimed in claim 1, wherein the first housing has a bottom surface adapted to be positioned on a circuit board, board locks being attached to the first housing and having legs extending beyond the bottom surface for being interferentially fitting into holes defined in the circuit board to retain the stacked connector assembly on the circuit board.

6. The stacked connector assembly as claimed in claim 1, wherein the first housing has opposite ends from which two arms respectively extend in a forward direction, each arm defining a guide channel adapted to guidingly receive a guide post of the first mating connector.

7. The stacked connector assembly as claimed in claim 6, wherein the first connector comprises a board lock attached to the first housing and comprising a grounding member extending into the guide channel for grounding the first mating connector.

8. The stacked connector assembly as claimed in claim 1 further comprising latching means between the first and second housings to securely fix the second housing to the first housing.

9. The stacked connector assembly as claimed in claim 8, wherein the latching means comprises latches depending from the second housing, each latch having a catch engaging with a notch defined in the first housing.

10. The stacked connector assembly as claimed in claim 8, wherein the latching means comprises a metal locking member that comprises a base section from which two beams extend, each beams being received in a channel defined in each of the first and second housing thereby fixing the first and second housings together.

11. The stacked connector assembly as claimed in claim 10, wherein the beams comprise barbs for interferentially engaging corresponding channels of the first and second housing.

12. The stacked connector assembly as claimed in claim 10, wherein spaced, resilient legs depend from the base section for interferentially engaging a hole defined in a circuit board.

13. The stacked connector assembly as claimed in claim 1, wherein the first arms correspond in position to the second arms with the latches of the second arms overlapping the remote end faces of the first arms, a first slit being defined through each latch, a second slit being defined in the remote end face of the corresponding first arm and in registration with the first slit, a first channel defined in each first arm and in communication with the second slit, a second channel defined in each second arm and in communication with the first slit, a locking member comprising a base section received in the first and second slits and first and second barbed beams extending from the base section and inteferentially fit into the first and second channels to securely fix the first and second housings together.

14. The stacked connector assembly as claimed in claim 1 further comprising a spacer retained between the first arms of the first housing, the spacer defining a plurality of spaced openings, each of the first and second terminals comprising a tail extending through a corresponding one of the openings of the spacer.

15. The stacked connector assembly as claimed in claim 13, wherein first housing is adapted to be positioned on a circuit board with the first and second terminals electrically connected to the circuit board and wherein the locking member comprises spaced, resilient legs depending from the base section for interferentially engaging a hole defined in the circuit board for retaining the stacked connector assembly on the circuit board.

16. The stacked connector assembly as claimed in claim 15 further comprising additional board locks attached to the first housing and adapted to engage with the circuit board to facilitate retaining the stacked connector assembly on the circuit board.

17. A stacked connector assembly comprising:

lower connector defining a lower insulative housing with a plurality of first contacts therein;

an upper connector defining an upper insulative housing with a plurality of second contacts therein;

hinged latching structures formed on a front bottom portion of the upper housing and a top portion of the lower housing; and a locking mechanism formed around rear portions of said upper and lower housing; wherein when the upper connector with the first contacts exposed on the rear portion thereof is assembled to the lower connector with the second contacts exposed on the rear portion thereof, the upper housing is pivotally assembled to the lower housing about said hinged latching structure in front-to-back and up-to-down directions, and the locking mechanism operates when said upper housing is rotated to a horizontal position in abutment with said lower housing so as to prevent said upper housing from reversed rotation;

and wherein the lower housing has opposite ends from which two first arms respectively extend in a rearward direction, each first arm having a remote end face defining a notch and wherein the upper housing has opposite ends from which two second arms respectively extend in a rearward direction, a latch depending from each second arm and forming a catch engaging the notch to securely fix the upper housing to the lower housing.

18. The stacked connector assembly as claimed in claim 17, wherein a discrete metal board lock fastens said upper housing and said lower housing together.

* * * * *